United States Patent [19]

Simon

[11] Patent Number: 5,022,666

[45] Date of Patent: Jun. 11, 1991

[54] FACADE FOR CHILD'S PLAY VEHICLE

[76] Inventor: Gregory L. Simon, 17302 33rd Ave. S., Seattle, Wash. 98188

[21] Appl. No.: 607,751

[22] Filed: Nov. 2, 1990

Related U.S. Application Data

[63] Continuation of Ser. No. 335,126, Apr. 5, 1989, abandoned.

[51] Int. Cl.[5] ..... A63G 19/00

[52] U.S. Cl. ..... 280/1.16; 280/1.13

[58] Field of Search ..... 280/1.12, 1.13, 1.16, 280/1.21, 1.22, 1.23, 1.188, 152.1, 152.2; 296/78.1; 493/350, 351, 390, 392, 959

[56] References Cited

U.S. PATENT DOCUMENTS

| | | | |
|---|---|---|---|
| D. 164,758 | 10/1951 | Bader . | |
| D. 298,930 | 12/1988 | Most | D12/178 |
| 2,236,678 | 4/1941 | Fedak | 280/1.13 |
| 2,578,682 | 12/1951 | Fernstrom | 280/1.14 |
| 2,599,309 | 6/1952 | Wunderly | 280/1.13 X |
| 2,708,584 | 5/1955 | Lohrey | 280/1.13 |
| 2,723,128 | 11/1955 | Kelly et al. | 280/1.13 X |
| 3,017,193 | 1/1962 | Klein | 280/1.188 X |
| 3,117,798 | 1/1964 | Young | 280/1.12 |
| 3,690,721 | 9/1972 | Herbert | 296/78.1 |
| 4,429,486 | 2/1984 | Bjornstad | 493/959 X |
| 4,655,497 | 4/1987 | Mallett | 296/78.1 |
| 4,744,573 | 5/1988 | Most | 280/1.13 |
| 4,790,555 | 12/1988 | Nobile | 289/289 |

*Primary Examiner*—Charles A. Marmor
*Assistant Examiner*—Alan M. Kagen
*Attorney, Agent, or Firm*—Glenn D. Bellamy

[57] ABSTRACT

A facade (10) for simulating the appearance of another object which is attached to a child's play vehicle (12). It includes a first substantially planar member (14) which has a front surface (18) and is attached to a forward portion of the play vehicle (12). The first member (14) is shaped to have a perimeter which substantially defines an anterior profile of the object. A second substantially planar member (16) is folded into a three-dimensional shape and attached to the first member (14). The second member (16) projects fowardly from the front surface (18) of the first member (14) and is shaped to define a forward profile of the object. It may also include a rear portion (160) which has first and second substantially planar side panels (162, 164) which are connected along upper edges (168, 170) and attached to the play vehicle (12) in a position to partially cover a rear wheel (172) of the vehicle (12). The first and second side panels (162, 164) have a perimeter which substantially defines a side profile of a rear portion of the object.

15 Claims, 4 Drawing Sheets

Fig. 1
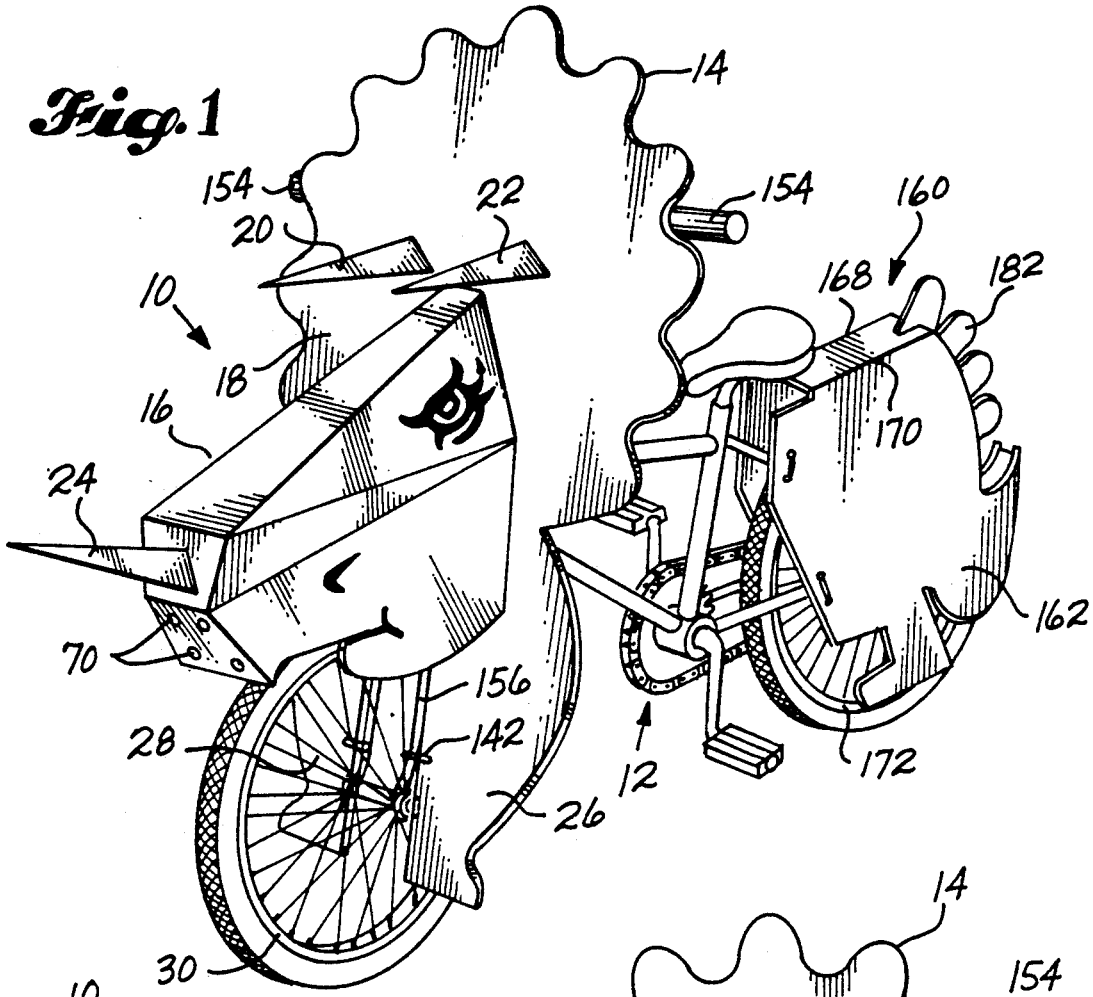
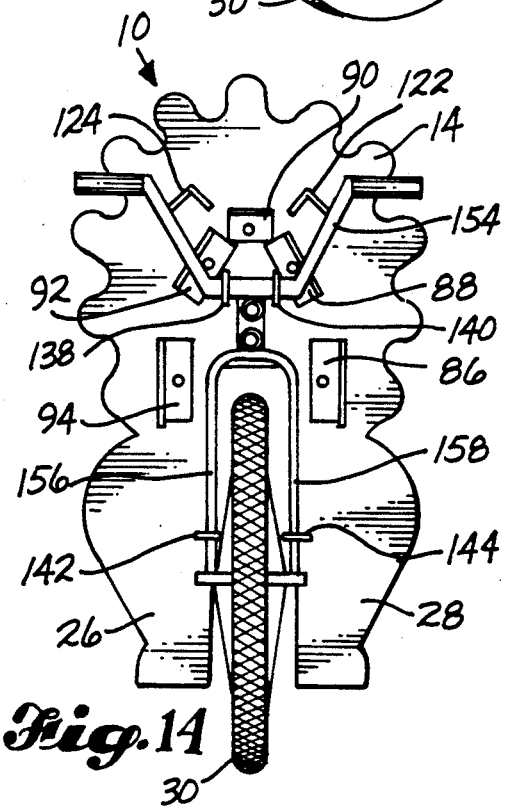
Fig. 14
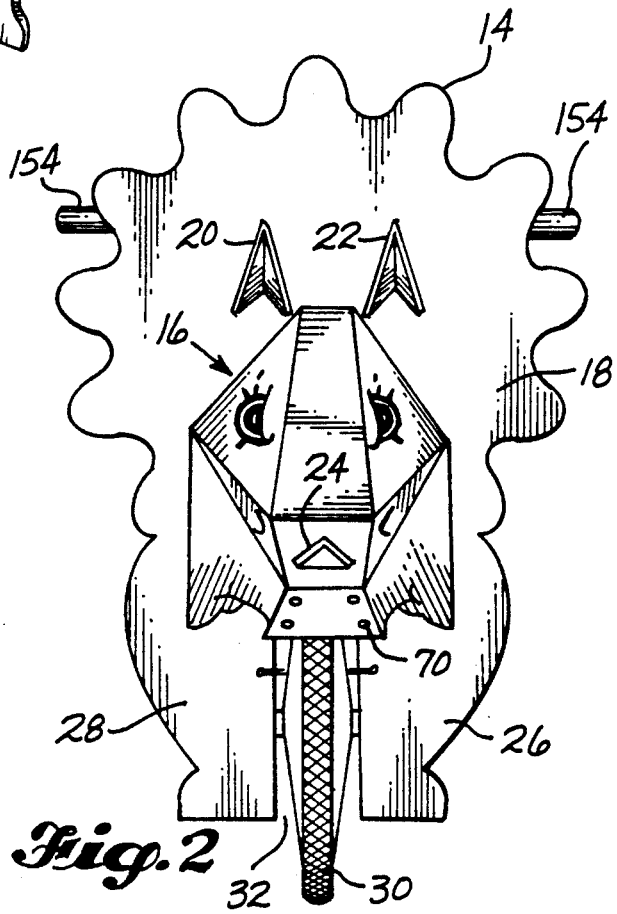
Fig. 2

Fig. 3
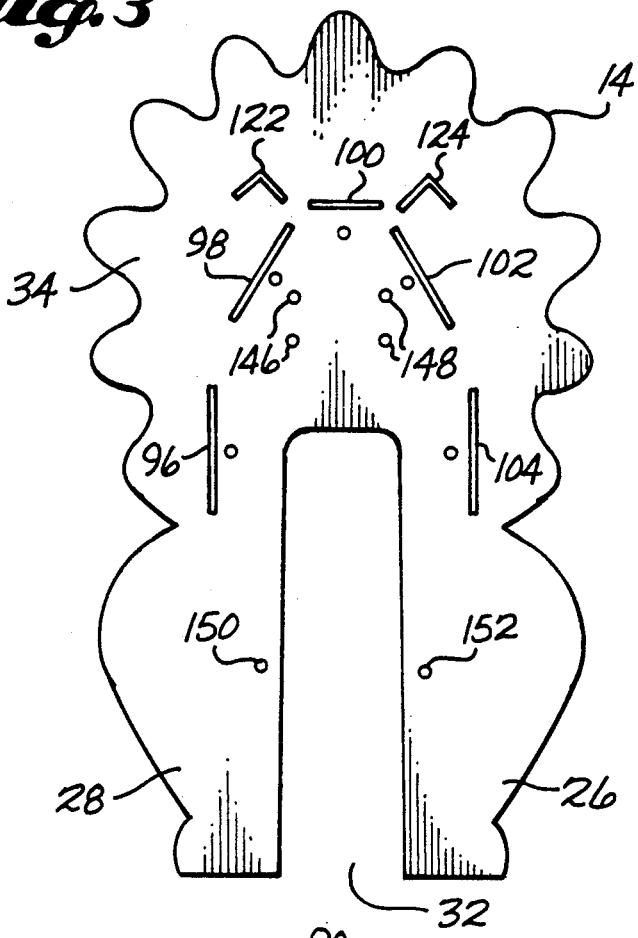
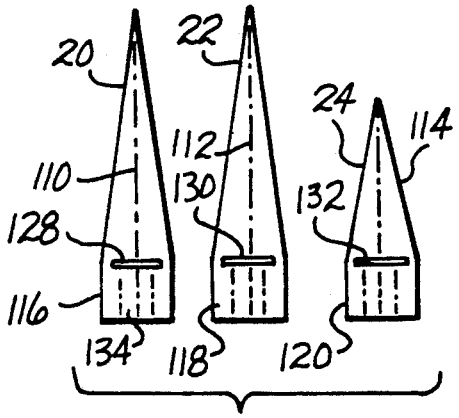
Fig. 4
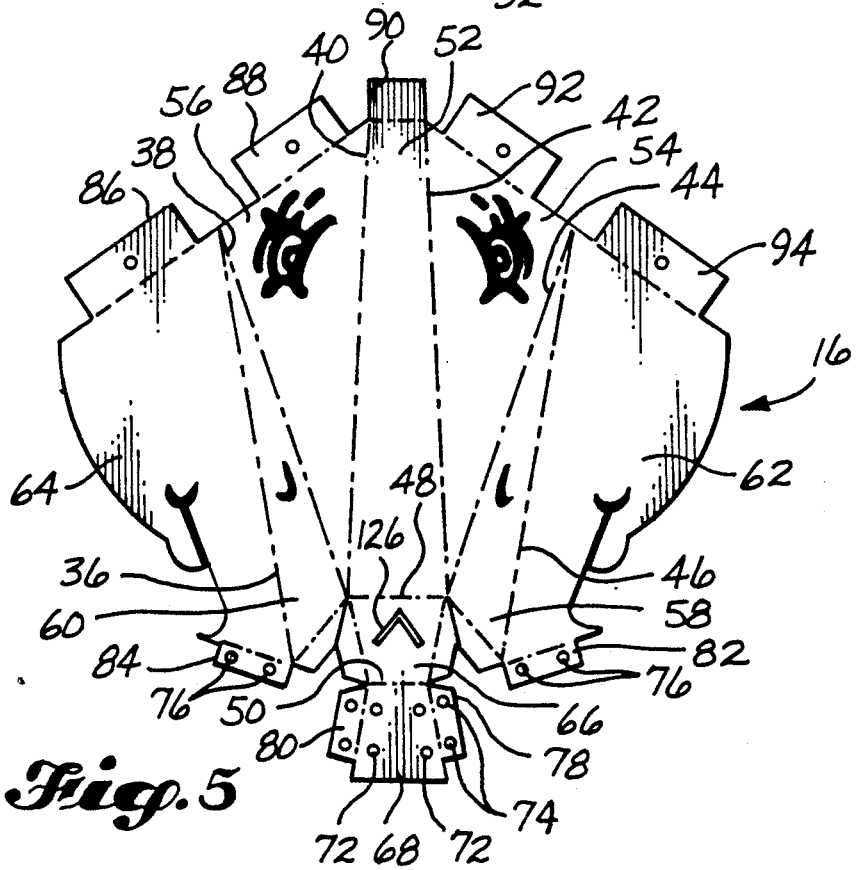
Fig. 5

FACADE FOR CHILD'S PLAY VEHICLE

This application is a continuation of application Ser. No. 335,126, filed Apr. 5, 1989, now abandoned.

TECHNICAL FIELD

This invention generally relates to a lightweight, inexpensive, and easy-to-assemble facade for a child's play vehicle, such as a bicycle or tricycle.

BACKGROUND ART

It is well known that children engage in and enjoy imaginative play. In order to make the imaginative play seem more realistic, some toy among the child's playthings may be decorated to take on the appearance of another object or an animal.

It is also well known that a child's interest in a play object may be short-lived. For this reason, it is desirable that any such playthings be economical so that the child may enjoy variety in his or her imaginative play. Also, because playthings are subject to rough use and are often broken or damaged, it is important that replacement cost be minimal.

Previously, attempts have been made to provide decorative attachments for a child's bicycle or tricycle. U.S. Pat. No. 164,758, issued Oct. 9, 1951, to K. W. Bader; U.S. Pat. No. 2,578,682, issued Dec. 18, 1951, to R. G. I. Fernstrom; and U.S. Pat. No. 2,708,584, issued May 17, 1955, to M. L. Lohrey each disclose attachments for a child's play vehicle in the form of a horse's head. U.S. Pat. No. 4,744,573, issued May 17, 1988, to Gordon Most, discloses a steer head attachment for a tricycle. U.S. Pat. No. 3,117,798, issued Jan. 14, 1964, to J. E. Young, discloses an accessory attachment to cause a tricycle to take on the appearance of a helicopter. Each of the above-listed patents discloses prefabricated, relatively expensive play attachments for a tricycle to cause it to appear more like an animal or aircraft. In some cases, assembly is complicated and includes overhead structure which may make the vehicle top heavy. Each device is limited by its structure to portraying only one object or animal. If damaged, the devices are expensive to replace.

DISCLOSURE OF THE INVENTION

The present invention provides a lightweight, economical, and easy-to-assembly facade for a velocipede or child's play vehicle which gives the vehicle the appearance of an ambulant object such as an animal or a vehicle, e.g. a dinosaur, elephant, dragon, aircraft, or spaceship.

The facade may also include a rear portion having first and second side panels connected along an upper portion thereof. The side panels are shaped to provide a lateral profile complementary of the rear end of the creature or object which is portrayed by the forward facade portion The present invention is simple and economical. The facade is made from essentially two pieces of material which may be shipped in a flattened condition and then assembled by the consumer Assembly requires only joining of the folded second member to the first member, and then attachment to the bicycle or tricycle. It is made of a lightweight, durable material which may be easily cut or drawn upon by the child, thereby further stimulating the child's creativity. The facade is safe and does not obstruct the child's vision. Because the material is inexpensive, parents can afford to provide their child with several embodiments of the facade which portray different animals or objects. The facade is also inexpensive to replace when it becomes worn or damaged.

BRIEF DESCRIPTION OF THE DRAWINGS

In the drawings, like reference numerals are used to represent like parts throughout, and FIG. 1 is a pictorial view of a facade according to a preferred embodiment of the invention having both front and rear portions mounted on a child's bicycle;

FIG. 2 is a front plan view of the embodiment shown in FIG. 1;

FIG. 3 is a plan view of a first planar member in an unassembled condition;

FIG. 4 shows a group of outwardly-extending members in an unassembled condition;

FIG. 5 shows the second member in a flat, unassembled condition;

FIG. 14 is a fragmentary rear plan view of the embodiment shown in FIG. 2 taken substantially along line 14—14 of FIG. 11.

BEST MODE FOR CARRYING OUT THE INVENTION

Figure 6:
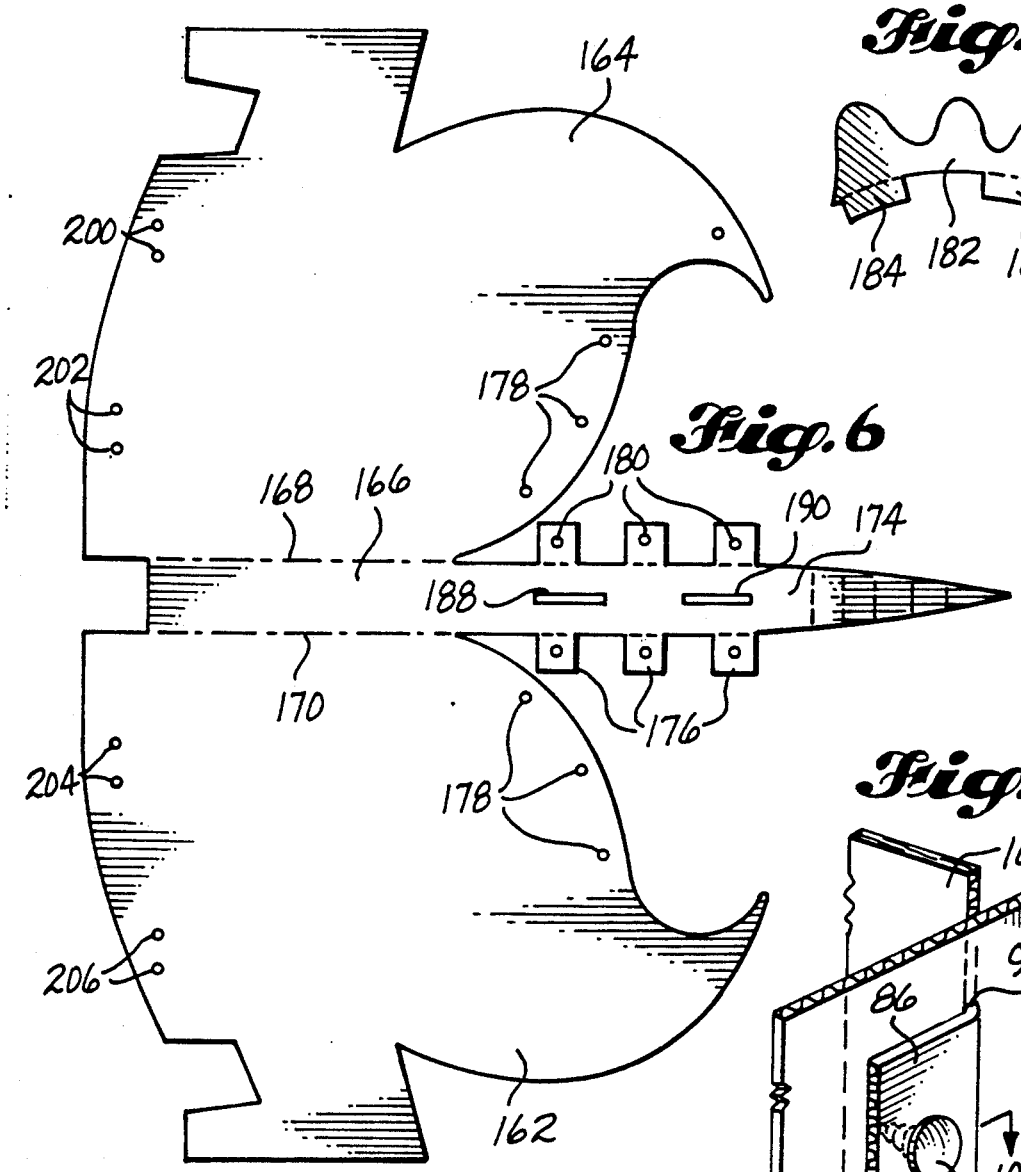
FIGS. 6 and 7 show parts of a rear portion in an unassembled condition.

Referring to the several figures of the drawing, and first to FIG. 1, therein is shown at 10 a facade according to a preferred embodiment of the invention in the image of a triceratops dinosaur mounted on a child's bicycle 12. Referring also to FIG. 2, the facade 10 includes a first substantially planar member 14 which is shaped to have a perimeter which substantially conforms with the anterior profile of a triceratops. A second member 16 extends forwardly outwardly from a front surface 18 of the first member 14. As shown also in FIG. 11, the second member is configured to have a lateral profile which substantially conforms with that of the triceratops. As part of this particular embodiment, the facade 10 also includes a pair of upper, forwardly extending horns 20, 22 and a nose horn 24.

FIGS. 3, 4 and 5 show the members 14, 16, 20, 22, 24 in their unassembled and unfolded condition. The first member 14 is a substantially planar plate or sheet of material. In the illustrated form, it has a pair of opposite leg portions 26, 28 which extend downwardly on opposite sides of the bicycle's front wheel 30. An opening 32 is left between the leg portions 26, 28 of sufficient width and heighth to allow proper clearance for the wheel 30. The upper portion 34 of this embodiment is formed to have a perimeter which resembles the anterior silhouette or profile of the depicted creature or object, in this case the distinctive plate of a triceratops dinosaur.

As shown in FIG. 5, the forwardly extending second member 16 is also formed from a single sheet of material. The illustrated embodiment is folded along fold lines 36, 38, 40, 42, 44, 46, 48, and 50. These fold lines define a central panel 52, a pair of eye panels 54, 56, a pair of nostril panels 58, 60, a pair of jaw panels 62, 64, an upper nose panel 66, and lower nose panel 68. The second member 16 is folded into the appropriate three-dimensional shape and fixed in place by the insertion of fastener members 70 through openings 72, 74, 76 in the lower nose panel 68, lower nose panel tabs. 78, 80 and jaw panel tabs 82, 84.

Figure 9:
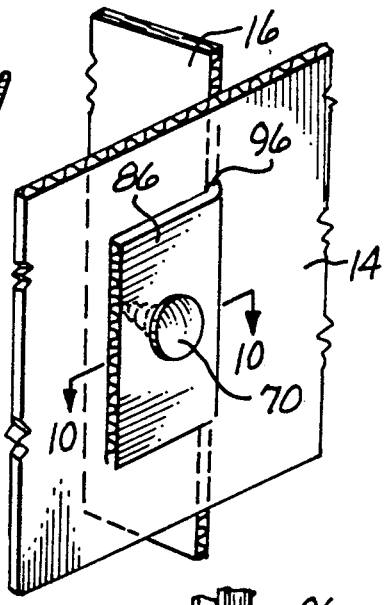
FIG. 9 is a fragmentary pictorial view of an attachment member.
Figure 10:
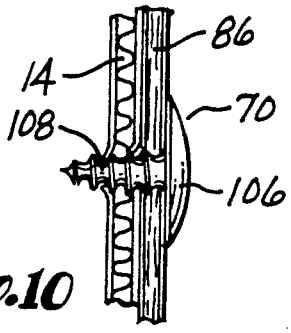
FIG. 10 is a cross-sectional view taken substantially along line 10—10 of FIG. 9.

The second member 16 is then attached to the first member 14 by insertion of attachment tabs 86, 88, 90, 92, 94 on the second member 16 through slots 96, 98, 100, 102, 104 in the first member 14. The friction fit of the tab-in-slot connection may be sufficient to hold the members 14, 16 together However, in preferred form, the tabs 86, 88, 90, 92, 94 are folded over and fastened to the first member 14 by "button" or friction fasteners 70, as shown in FIGS. 9, 10, and 14. Referring to FIG. 10, the fastener 70 has an enlarged head portion 106 and an annularly notched stem portion 108. The stem portion 108 is pressed through the relatively rigid sheets 14, 86 to tightly engage the members together Button-type fasteners 70, such as that illustrated, are well known and commercially available. Other fastening means, such as glueing or stapling, may also be suitable.

Figure 8:
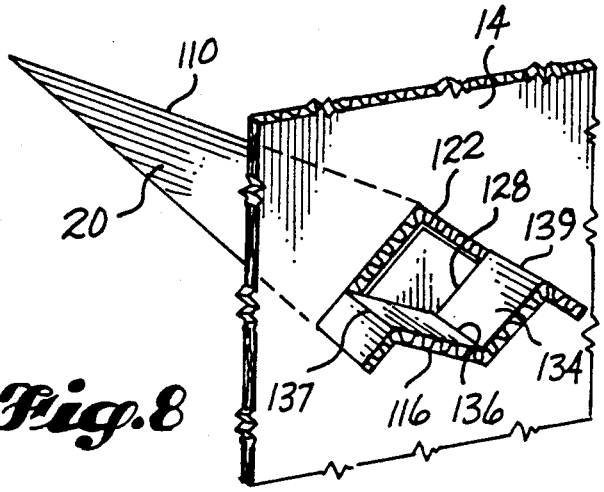
FIG. 8 is a fragmentary pictorial view of a connection of an outwardly-extending member attached to the first planar member.

As shown in FIGS. 4 and 8, each horn member 20, 22, 24 is formed of a single piece of sheet material. Each horn 20, 22, 24 is folded at approximately a right angle along a central longitudinal fold line 110, 112, 114. At the base end of each horn 20, 22, 24 is a tab portion 116, 118, 120. Each tab portion 116, 118, 120 is inserted through an L-shaped slot 122, 124, 126 which is formed at the appropriate position in the upper portion 34 of the first 14 or upper nose portion 66 of the second member 16 in the illustrated embodiment. A transverse cut 128, 130, 132 is formed across each horn member 20, 22, 24 perpendicularly intersecting the central longitudinal fold line 110, 112, 114, but not extending to the outward edges of the horn member 20, 22, 24. As shown in FIG. 8, a central portion 34 is displaced, reversing the fold direction of the central longitudinal fold line 136 and creating two fold lines 137, 139. This displaced central portion 134 prevents the horn 20 from normally being dislocated from the slot 122. However, substantial longitudinal or lateral impact against the horn member 20 will displace or deflect it. This provides a desirable degree of safety when the invention is used as a child's plaything.

The assembled facade 10 is attached to the play vehicle 12 by passing flexible tie straps 138, 140, 142, 144 through openings 146, 148, 150, 152 formed in the first member 14 and around portions of the bicycle's frame. These openings may be located as necessary to conveniently achieve this attachment. In preferred form, two pair of holes 146, 148 are formed adjacent the handlebars 154. Flexible straps 138, 140, such as well-known and readily available wire ties, are looped through the openings 146, 148 and around the handlebars 154. Any suitable tying device or clip may be used to perform this function. In preferred form, openings 150, 152 are formed in the leg portions 26, 28 of the first member 14 adjacent front wheel support forks 156, 158 of the bicycle 12. Similar tie straps 142, 144 are passed through these openings 150, 152 and around the forks 156, 158. It has been found that attachment at the above-described locations will securely and inexpensively attach the facade 10 to the bicycle 12.

Figures 11, 12, 13:
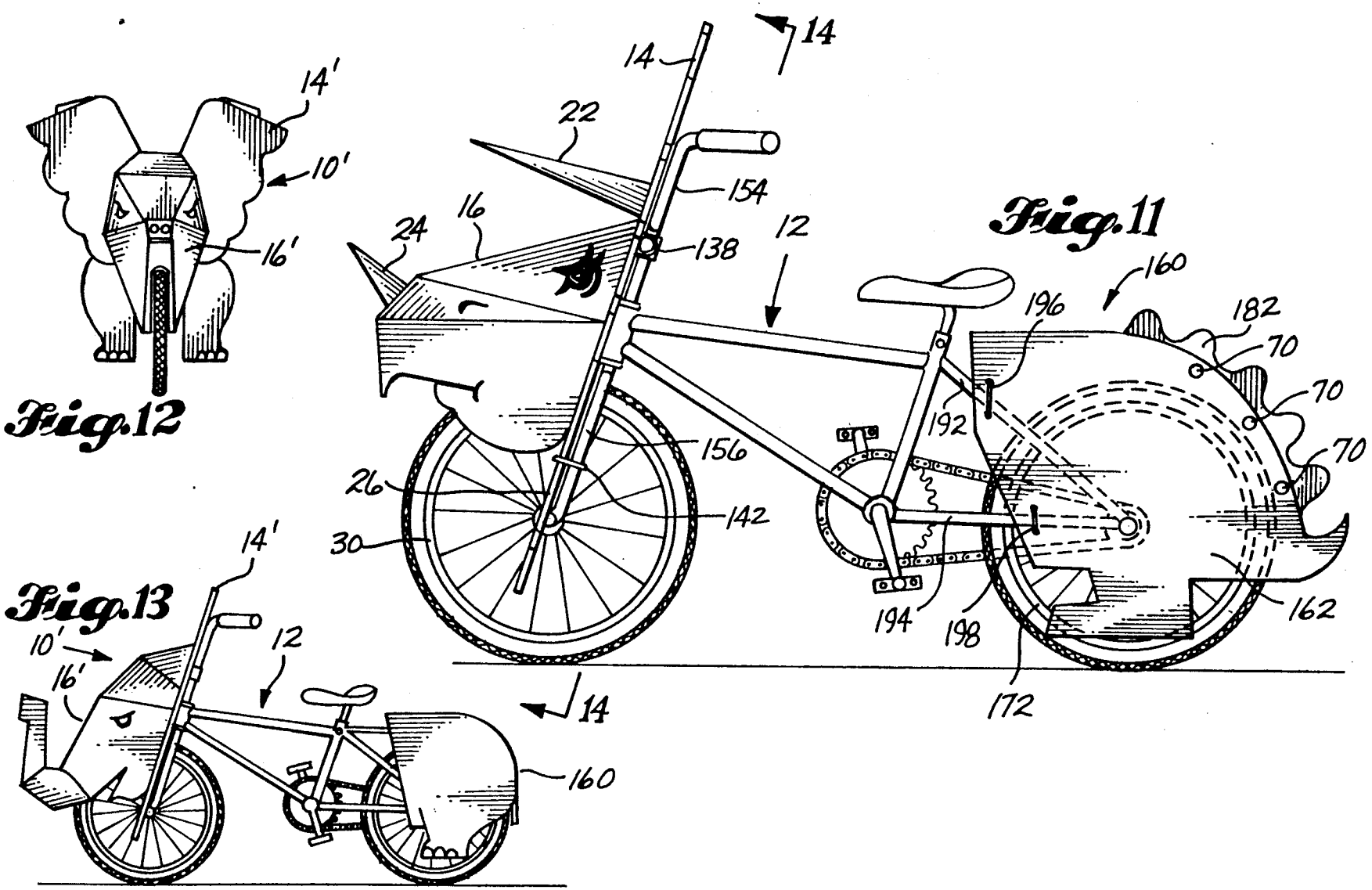
FIG. 11 is a side plan view of the embodiment shown in FIG. 1.
FIG. 12 is a front plan view similar to FIG. 2 but of an alternative embodiment.
FIG. 13 is a side plan view similar to FIG. 11, but showing the alternative embodiment shown in FIG. 12.

As shown in FIGS. 1 and 11, an alternative embodiment of the invention also includes a rear portion 160. In the illustrated embodiment, this rear portion 160 is shaped to substantially conform to a lateral profile of a rear portion of the depicted triceratops. The embodiment shown in FIG. 13 shows a rear portion 160' which is shaped to generally resemble a rear portion of the depicted elephant.

Figure 7:
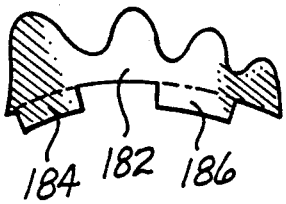

FIGS. 6 and 7 show the rear portion 160 in an unfolded an unassembled condition. FIG. 6 shows first and second side panels 162, 164 and an upper central panel 166. These panels 162, 164, 166 are folded along fold lines 168, 170 which define the upper boundaries of the side panels 162, 164 and side boundaries of the central panel 166. The central panel 166 is dimensioned to provide sufficient width and clearance of the bicycle's rear wheel 172. The tail portion 174 of the central panel 166 is bent or folded to conform with the contour or perimeter of the side panels 162, 164. This tail portion 174 may include attachment tab portions 176. Fasteners 70 may be passed through openings 178 formed in the side panels 162, 164 which are aligned with openings 180 formed in the tabs 176. This connection is substantially the same as that shown in FIG. 10. Attachment may also be made by glueing, stapling or any other suitable means.

As shown in FIGS. 1, 7, and 11, the rear portion 160 may also include an upwardly standing tail plate 182. The tail plate 182 is attached to the tail portion 174 of the central panel 166 by insertion of attachment tabs 184, 186 into slots 188, 190. Generally, the friction fit of the tab-in-slot attachment is sufficient to hold the tail plate 182 in place. However, if deemed necessary, the tab portions 184, 186 may be bent in opposite directions or attached by any of the above-described methods.

The assembled rear portion 160 is placed generally over the rear wheel 172 and attached to portions of the bicycle's frame 192, 194 by flexible tie straps 196, 198. These tie straps 196, 198 are similar to that previously described for attachment of the forward portion of the facade to the bicycle 12. The straps 196, 198 are inserted through openings 200, 202, 204, 206 formed in the side panels 162, 164 of the rear portion 160 and around the frame portions 192, 194 to provide a secure attachment.

In preferred form, the members 14, 16, 20, 22, 24 are made of a lightweight, inexpensive sheet material, such as corrugated cardboard. The material may be coated or otherwise made water resistant to increase its durability. Also, plastic, structural foam, or foam core board sheets which are lightweight and relatively rigid, but can easily be folded, are suitable. Use of a lowcost material makes the facade 10 readily replaceable in the event of damage and allows a child to enjoy a variety of styles or characters.

The front and rear portions of the facade 10, 160 may be preprinted to bear indicia representing features of the depicted animal or object. The printed indicia may be elaborate to make the facade appear lifelike or may be kept simple to cultivate a child's imagination and allow further decoration by the child. The nature of the described invention allows it to be packaged and shipped in a flat condition and then easily assembled by the consumer. The completed facade is extremely lightweight, thereby not hindering the child's ability to propel the vehicle 12. The shape and construction of; the facade 10 does not interfere with the vehicle's braking or steering mechanisms and will not obstruct the vision of the child as the vehicle 12 is propelled. The construction, shape or attachment of the facade 10 to the vehicle 12 is easily altered by the consumer. Any of the members may be easily cut and holes relocated to fit the facade 10 to any given model of play vehicle 12. Some alteration in style or shape may be necessary to fit the facade 10 to a tricycle. In concern for the child's safety, the construction of the facade 10 allows it to collapse upon substantial impact.

Of course, the particular shape and configuration of the above-described members would vary according to the particular animal or object which is being depicted by the facade. For example, as shown in FIGS. 12 and 13, therein is shown at 10' an embodiment which depicts an elephant. In this example, the first member 14 has a silhouette which depicts the characteristic large ears of an elephant and its front legs. The second member 16' is folded and attached to the first member 14' in a manner such that its lateral profile depicts the characteristic head and trunk of an elephant. Other ambulant animals or objects, i.e. those which are reasonably expected to be seen in a mobile state, may also be characterized by this invention. Animals having a distinctive silhouette or profile, such as a male lion, or another vehicle, such as an aircraft or space ship, are readily adaptable and easily portrayed by a facade according to the present invention.

It is to be understood that the illustrated and above-described embodiments are for example only. Many variations in style, shape or character may be made to the invention so that it depicts any desired creature or thing. Many variations may be made in construction or assembly of the facade without departing from the scope and spirit of the invention. Therefore, my patent rights are not to be limited by the above-described embodiments, but rather by the below-appended claim or claims interpreted according to recognized doctrines of claim interpretation, including the doctrine of equivalents.

What is claimed is:

1. A facade for use with and attachment to a velocipede, to provide with said velocipede a simulated appearance of an ambulant object such as an animal or vehicle, comprising:

a planar first member attachable to a forward portion of the velocipede, said first member having a front surface extending laterally of the velocipede and having a distinctive perimeter shape;

a planar second member folded into a three-dimensional form and attached to a central portion of said first member to project forwardly from its front surface;

said second member having a base area including an edge portion where it is attached to said first member;

said first member being of an area larger than said base area and having a planar border portion extending outwardly beyond said base area;

at least one of said first and second members including an open portion positioned to receive a portion of said velocipede;

said distinctive perimeter shape of said planar first member providing an anterior outline shape of the simulated object;

said three-dimensional form of said folded second member presenting a side profile of a portion of said simulated object; and said distinctive perimeter shape and planar border portion of said planar first member with said folded second member and its location of attachment to the planar first member providing a visual appearance of a three-dimensional form portion of the simulated object, such that, in cooperation with the placement of the facade on the velocipede, said velocipede is made to simulate the appearance of said other ambulant object,

2. A facade according to claim 1, wherein said second member includes a tab portion which is insertable through a slot formed in said first member, said tab portion being bendable to prevent removal of said tab portion from said slot.

3. A facade according to claim 2, further comprising a friction fastener which is inserted through openings formed in said tab portion and said first member.

4. A facade according to claim 1, wherein said velocipede includes handle bars for steering the velocipede and said first member is attached to said handle bars.

5. A facade according to claim 1, wherein said first member includes first and second downwardly extending leg portions which are laterally outwardly adjacent a front wheel of said velocipede.

6. A facade according to claim 5, wherein said second member extends outwardly above said front wheel and partially covers a top portion of said front wheel.

7. A facade according to claim 5, wherein said front wheel is supported by first and second fork members and said first and second leg portions are each attached to one of said fork members.

8. A facade according to claim 7, wherein said velocipede includes handle bars for steering the velocipede and said first member is attached to said handle bars.

9. A facade according to claim 1, wherein said second member is folded along at least one substantially linear fold line.

10. A facade according to claim 9, wherein said second member is folded along a plurality of separate substantially linear fold lines.

11. A facade according to claim 1, wherein at least one of said first and second members includes indicia thereon representative of the object being simulated.

12. A facade for use with and attachment to a velocipede, to provide with said velocipede a simulated appearance of an ambulant object such as an animal or vehicle, comprising:

a front portion including:

a planar first member attachable to a forward portion of the velocipede, said first member having a front surface extending laterally of the velocipede and having a distinctive perimeter shape;

a planar second member folded into a three-dimensional form and attached to a central portion of said first member to project forwardly from its front surface;

said second member having a base area including an edge portion where it is attached to said first member;

said first member being of an area larger than said base area and having a planar border portion extending outwardly beyond said base area;

at least one of said first and second members including an opening portion positioned to receive a portion of said velocipede;

said distinctive perimeter shape of said planar first member providing an anterior outline shaped of the simulated object;

said three-dimensional form of said cut and folded second member representing a side profile of said simulated object; and a rear portion including:

first and second planar side panels attachable to opposite sides of a rear portion of the velocipede, said side panels extending substantially longitudinally of the velocipede and having a distinctive perimeter shape which presents a side profile of a rear portion of said simulated object; and said distinctive perimeter shape and planar border portion of said planar first member with said folded second member and its location of attachment to the planar first member, in cooperation with the distinctive perimeter shape of said side panels, providing a visual appearance of a three-dimensional form portion of the simulated ambulant object.

13. A facade according to claim 12, wherein said rear portion further includes a central panel which interconnects said first and second side panels along upper edges thereof.

14. A facade according to claim 13, wherein said rear portion is attached to said velocipede by attachment of said first and second side panels to a rear frame portion of said velocipede.

15. A facade according to claim 12, wherein said rear portion is attached to said velocipede by attachment of said first and second side panels to a rear frame portion of said velocipede.

* * * * *